US008242980B2

(12) United States Patent
Choi et al.

(10) Patent No.: US 8,242,980 B2
(45) Date of Patent: Aug. 14, 2012

(54) PIXEL CIRCUIT CONFIGURED TO PROVIDE FEEDBACK TO A DRIVE TRANSISTOR, DISPLAY INCLUDING THE SAME, AND DRIVING METHOD THEREOF

(75) Inventors: Sang Moo Choi, Suwon-si (KR); Wang-Jo Lee, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 801 days.

(21) Appl. No.: 11/826,909

(22) Filed: Jul. 19, 2007

(65) Prior Publication Data

US 2008/0055299 A1 Mar. 6, 2008

(30) Foreign Application Priority Data

Aug. 30, 2006 (KR) ..... 10-2006-0083146

(51) Int. Cl.
*G09G 3/30* (2006.01)
*G09G 3/10* (2006.01)

(52) U.S. Cl. ..... 345/76; 315/169.3

(58) Field of Classification Search ..... 345/76; 315/169.3

See application file for complete search history.

(56) References Cited

U.S. PATENT DOCUMENTS 6,351,078 B1 2/2002 Wang et al.
6,933,756 B2 * 8/2005 Miyazawa ..... 315/169.3
7,091,667 B2 * 8/2006 Sakaguchi et al. ..... 315/169.1
7,109,952 B2 9/2006 Kwon
7,173,590 B2 2/2007 Uchino et al.
7,230,591 B2 6/2007 Inukai
7,335,914 B2 2/2008 Shibusawa
7,629,951 B2 * 12/2009 Wu ..... 345/76
7,679,587 B2 3/2010 Kwak
2003/0107536 A1 * 6/2003 Ishizuka et al. ..... 345/76
2004/0032380 A1 * 2/2004 Kanauchi ..... 345/72
2004/0196223 A1 10/2004 Kwon
2005/0269958 A1 * 12/2005 Choi et al. ..... 315/169.3
2006/0012549 A1 1/2006 Ikeda
2006/0103323 A1 * 5/2006 Eom et al. ..... 315/169.3

(Continued)

FOREIGN PATENT DOCUMENTS

CN 1388504 A 1/2003

(Continued)

OTHER PUBLICATIONS

Chinese Certificate of Patent for Invention in CN 200710147222.6, dated Oct. 20, 2010 (Choi, et al.), Chinese Office Action from prosecution of corresponding Chinese application.

*Primary Examiner* — Adam J Snyder
(74) *Attorney, Agent, or Firm* — Lee & Morse, P.C.

(57) ABSTRACT

A pixel circuit includes first, second, and third transistors, and first and second capacitors, wherein the first transistor is controlled by a scan line and is configured to controllably couple a data line to the first capacitor and a gate electrode of the second transistor, the second transistor is controlled by a voltage provided by the first and second capacitors, the third transistor is controlled by the scan line and is configured to controllably couple a first power supply to the second capacitor, and the first power supply is controllably coupled to a light source by the second transistor.

10 Claims, 5 Drawing Sheets

U.S. PATENT DOCUMENTS

| | | | | |
|---|---|---|---|---|
| 2006/0114196 | A1 * | 6/2006 | Shin et al. | 345/76 |
| 2006/0170628 | A1 | 8/2006 | Yamashita et al. | |
| 2009/0073092 | A1 | 3/2009 | Numao | |

FOREIGN PATENT DOCUMENTS

| | | | |
|---|---|---|---|
| JP | 6-270462 | | 9/1994 |
| JP | 2002-072926 | | 3/2002 |
| JP | 2003-224437 | | 8/2003 |
| JP | 2005-215102 | A | 8/2005 |
| JP | 2005-345723 | A | 12/2005 |
| JP | 2006-053539 | | 2/2006 |
| JP | 2006-078921 | A | 3/2006 |
| JP | 2006-146168 | A | 6/2006 |
| JP | 2006-184577 | | 7/2006 |
| JP | 2006-215213 | A | 8/2006 |
| KR | 10-1998-0060018 | | 10/1998 |
| KR | 10-2003-0095215 | A | 12/2003 |
| KR | 10-2005-0098485 | A | 10/2005 |
| WO | WO 2004/102517 | A1 | 11/2004 |
| WO | WO 2004097782 | A1 * | 11/2004 |
| WO | WO 2006/060519 | A2 | 6/2006 |
| WO | WO 2007/018006 | A1 | 2/2007 |

* cited by examiner

PIXEL CIRCUIT CONFIGURED TO PROVIDE FEEDBACK TO A DRIVE TRANSISTOR, DISPLAY INCLUDING THE SAME, AND DRIVING METHOD THEREOF

BACKGROUND OF THE INVENTION

1. Field of the Invention

The present invention relates to a pixel circuit, a display including the same, and a driving method thereof. More particularly, the present invention relates to a pixel circuit including a feedback feature, a display including the same, and a driving method thereof.

2. Description of the Related Art

Recently, various flat panel displays capable of reducing weight and volume, which are disadvantages of cathode ray tubes (CRTs), have been developed. Flat panel displays include, e.g., liquid crystal displays (LCDs), field emission displays (FEDs), plasma display panels (PDPs), and organic light emitting displays.

Among the flat panel displays, the organic light emitting displays may make use of organic light emitting diodes (OLEDs), which may emit light by re-combination of electrons and holes. The organic light emitting display may offer various advantages, e.g., high response speed and low power consumption.

A pixel of a conventional organic light emitting display may include an OLED and a pixel circuit. The pixel circuit may be coupled to a data line and a scan line, and may control the OLED. An anode electrode of the OLED may be coupled to the pixel circuit, and a cathode electrode thereof may be coupled to a power supply, e.g., ELVSS. The OLED may generate light of a predetermined luminance corresponding to an electric current provided by the pixel circuit. In particular, when a scan signal is supplied to the scan line, the pixel circuit may control the amount of an electric current provided to the OLED in correspondence with a data signal provided to the data line.

The pixel circuit may include first and second transistors and a storage capacitor. The first transistor may control an amount of an electric current flowing from a power supply ELVDD to the power supply ELVSS through an OLED according to a voltage charged in the storage capacitor, and the OLED may emit light corresponding to the amount of an electric current supplied from the first transistor. The second transistor may be coupled between the data line and the scan line. The second transistor coupled to the scan line and the data line may controllably provide a data signal from the data line to the storage capacitor, and the storage capacitor may be charged with a voltage corresponding to the data signal.

The above-described pixel circuit of the conventional organic light emitting display may not be entirely satisfactory, as a display including a plurality of such pixel circuits may not display an image of uniform luminance. In detail, threshold voltages of the drive transistors in the pixel circuits may be different depending on, e.g., fabrication process variations. When the threshold voltages of the drive transistors are different, the OLEDs in the display may emit light of differing luminances even though a data signal representing a same gradation is supplied to each of the pixel circuits.

One approach to overcoming such drawbacks is to provide a pixel circuit that includes threshold voltage compensation for the drive transistor. However, such threshold voltage compensation may require six or more transistors in each pixel circuit, as well as additional wiring for controlling the transistors. Moreover, when six or more transistors are included in the pixel circuit, the structure of the pixel circuit may become complex. Furthermore, the above-described threshold voltage compensation may not compensate for other factors such as the carrier mobility of the drive transistor.

SUMMARY OF THE INVENTION

The present invention is therefore directed to a pixel circuit, a display including the same, and a driving method thereof, which substantially overcome one or more of the problems due to the limitations and disadvantages of the related art.

It is therefore a feature of an embodiment of the present invention to provide a pixel circuit configured to provide feedback to a drive transistor.

It is therefore another feature of an embodiment of the present invention to provide a pixel circuit configured to partially or fully compensate for variations in characteristics of a drive transistor.

At least one of the above and other features and advantages of the present invention may be realized by providing a pixel circuit, including first, second, and third transistors, and first and second capacitors, wherein the first transistor is controlled by a scan line and is configured to controllably couple a data line to the first capacitor and a gate electrode of the second transistor, the second transistor is controlled by a voltage provided by the first and second capacitors, the third transistor is controlled by the scan line and is configured to controllably couple a first power supply to the second capacitor, and the first power supply is controllably coupled to a light source by the second transistor.

The light source may be an organic light emitting diode. The first, second and third transistors may be PMOS transistors. The first and second capacitors may both be coupled to the gate electrode of the second transistor.

A gate electrode of the first transistor may be coupled to the scan line, and a first electrode of the first transistor may be coupled to the data line, the gate electrode of the second transistor may be coupled to a second electrode of the first transistor, and a first electrode of the second transistor may be coupled to the first power supply, a gate electrode of the third transistor may be coupled to the scan line, a first electrode of the third transistor may be coupled to the first power supply, and a second electrode of the third transistor may be coupled to a second electrode of the second transistor, a first electrode of the light source may be coupled to the second electrode of the second transistor, and a second electrode of the light source may be coupled to a second power supply, the first capacitor may be coupled between the gate electrode and the first electrode of the second transistor, and the second capacitor may be coupled between the gate electrode and the second electrode of the second transistor.

A voltage provided by the first power supply may be higher than a voltage provided by the second power supply. The pixel circuit may further include a fourth transistor, wherein the fourth transistor may be controlled by an emission control line and may be configured to controllably couple the second transistor to the light source.

At least one of the above and other features and advantages of the present invention may also be realized by providing a display, including a scan driver configured to sequentially provide a scan signal to scan lines, a data driver configured to provide a data signal to data lines, and pixels coupled to respective scan and data lines, each of the pixels having a pixel circuit including first, second, and third transistors, and first and second capacitors, wherein the first transistor may be controlled by a scan line and may be configured to controllably couple a data line to the first capacitor and a gate electrode of the second transistor, the second transistor may be controlled by a voltage determined by the first and second capacitors, the third transistor may be controlled by the scan line and is configured to controllably couple a first power supply to the second capacitor, and the first power supply may be controllably coupled to a light source by the second transistor.

The light source may be an organic light emitting diode. The first, second and third transistors may be PMOS transistors.

The first transistor may be configured to be turned-on when a scan signal at a first level is supplied to the scan line, the second transistor may be configured to control an electric current flowing from the first power supply to a second power supply through the light source, the third transistor may be configured to transfer a voltage of the first power supply to the second capacitor when the scan signal at the first level is supplied to the scan line, the first capacitor may be coupled between the first transistor and the first power supply and is configured to be charged with a voltage corresponding to a data signal when the first transistor is turned on, and the second capacitor may be configured to regulate a voltage applied to a gate electrode of the second transistor based on a voltage output by the second transistor when an electric current is supplied to the light source.

The first and second capacitors may both be coupled to the gate electrode of the second transistor. A gate electrode of the first transistor may be coupled to the scan line, and a first electrode of the first transistor may be coupled to the data line, the gate electrode of the second transistor may be coupled to a second electrode of the first transistor, and a first electrode of the second transistor may be coupled to the first power supply, a gate electrode of the third transistor may be coupled to the scan line, a first electrode of the third transistor may be coupled to the first power supply, and a second electrode of the third transistor may be coupled to a second electrode of the second transistor, a first electrode of the light source may be coupled to the second electrode of the second transistor, and a second electrode of the light source may be coupled to a second power supply, the first capacitor may be coupled between the gate electrode and the first electrode of the second transistor, and the second capacitor may be coupled between the gate electrode and the second electrode of the second transistor.

A voltage provided by the first power supply may be higher than a voltage provided by the second power supply. The scan driver may be further configured to sequentially provide an emission control signal to emission control lines, the pixel circuit may further include a fourth transistor, wherein the fourth transistor may be controlled by an emission control line and may be configured to controllably couple the second transistor to the light source, and the fourth transistor may be configured to be turned-on when the emission control signal at a first level is supplied to the emission control line. The emission control signal at the first level may not overlap the scan signal at the first level for a given pixel.

At least one of the above and other features and advantages of the present invention may further be realized by providing a method of driving a display, including supplying a scan signal at a first level to a scan line to charge a first capacitor with a voltage corresponding to a data signal, and providing a voltage of a first power supply to an electrode of a drive transistor while the first capacitor is charged with the voltage corresponding to the data signal, and supplying an electric current from the first power supply to a light source through the drive transistor, the electric current corresponding to the voltage charged in the first capacitor, and controlling a voltage of a gate electrode of the drive transistor according to a voltage variation between a voltage applied to the light source and the voltage of the first power supply while the electric current is supplied to the light source.

A second capacitor may be coupled between the electrode of the drive transistor and the gate electrode of the drive transistor, and the first capacitor may be coupled between another electrode of the drive transistor and the gate electrode of the drive transistor. Supplying the electric current from the first power supply to the light source through the drive transistor may further include transferring the current through an emission control transistor that is controlled by an emission control signal. The emission control signal at a first level may not overlap the scan signal at the first level for a given pixel.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
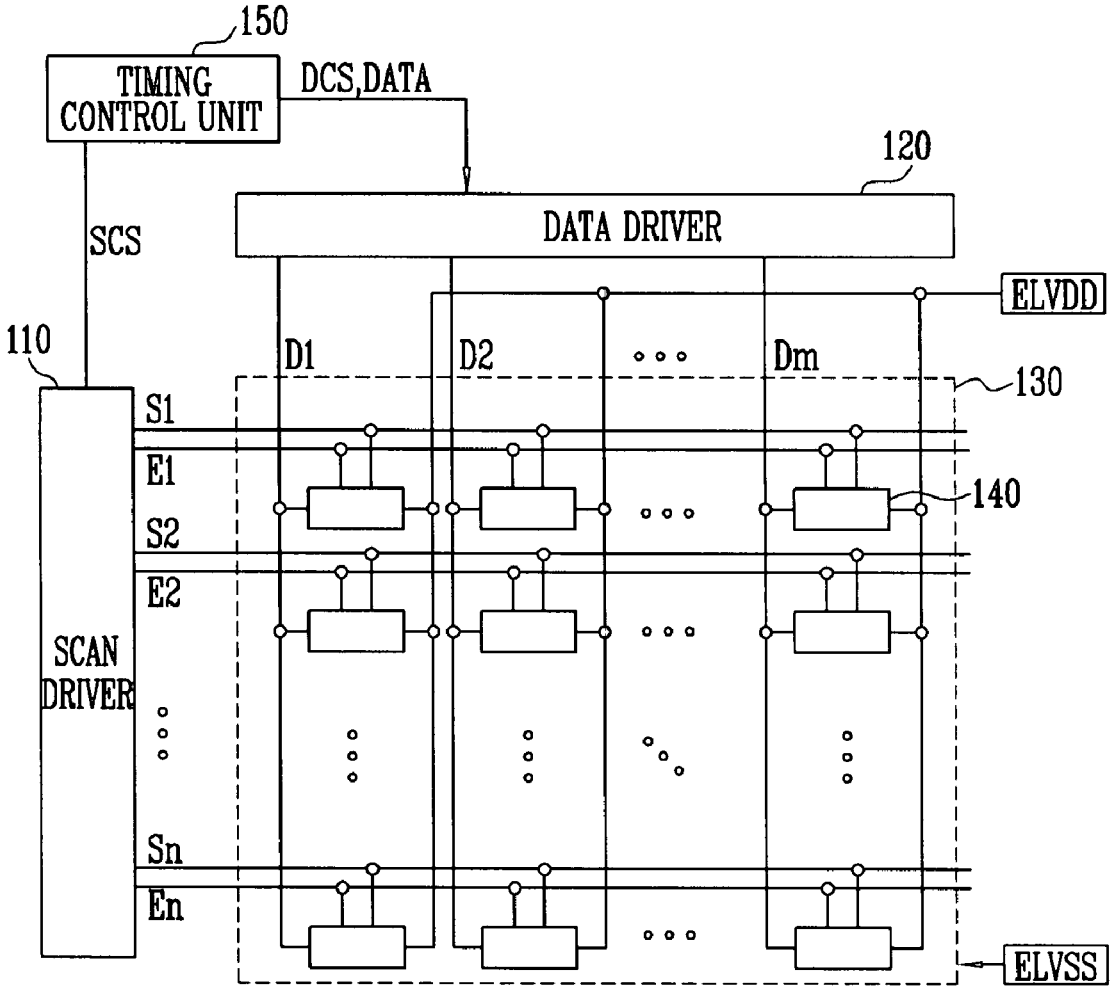
FIG. 1 illustrates a display according to an embodiment of the present invention.

Korean Patent Application No. 10-2006-0083146, filed on Aug. 30, 2006, in the Korean Intellectual Property Office, and entitled: "Pixel, Organic Light Emitting Display, and Driving Method Thereof," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Where an element is shown connected or coupled to a second element, the element may be directly connected or coupled to second element, or may be indirectly connected or coupled to second element via one or more other elements. In the drawings, elements may be omitted for clarity. Like reference numerals refer to like elements throughout.

FIG. 1 illustrates a display according to an embodiment of the present invention. Referring to FIG. 1, the display according to a first embodiment of the present invention may include a pixel portion 130, a scan driver 110, a data driver 120, and a timing control unit 150. The pixel portion 130 may include a plurality of pixels 140, which may be coupled to scan lines S1 to Sn, emission control lines E1 to En, and data lines D1 to Dm. The scan driver 110 may drive the scan lines S1 to Sn and the emission control lines E1 to En. The data driver 120 may drive the data lines D1 to Dm. The timing control unit 150 may control the scan driver 110 and the data driver 120.

The scan driver 110 may receive a scan driving control signal SCS from the timing control unit 150. The scan driver 110 may sequentially provide scan signals to the scan lines S1 through Sn. Further, the scan driver 110 may sequentially provide emission control signals to the emission control lines E1 through En.

The data driver 120 may receive a data driving signal DCS from the timing control unit 150. Further, the data driver 120 may provide data signals to the data lines D1 through Dm in synchronization with the scan signals.

The timing control unit 150 may provide the data driving signal DCS and the scan driving signal SCS corresponding to synchronizing signals supplied from an external source (not shown). Further, the timing control unit 150 may provide externally supplied data DATA to the data driver 120.

The pixel portion 130 may receive external power from first and second power supplies ELVDD and ELVSS, respectively, and may provide the power to the pixels 140. A voltage of the first power supply ELVDD may be higher than that of the second power supply ELVSS. The pixels 140 may receive the power of the first power supply ELVDD and the power of the second power supply ELVSS, and may generate light corresponding to a data signal. Emission times of the pixels 140 may be controlled by an emission control signal.

Figure 2:
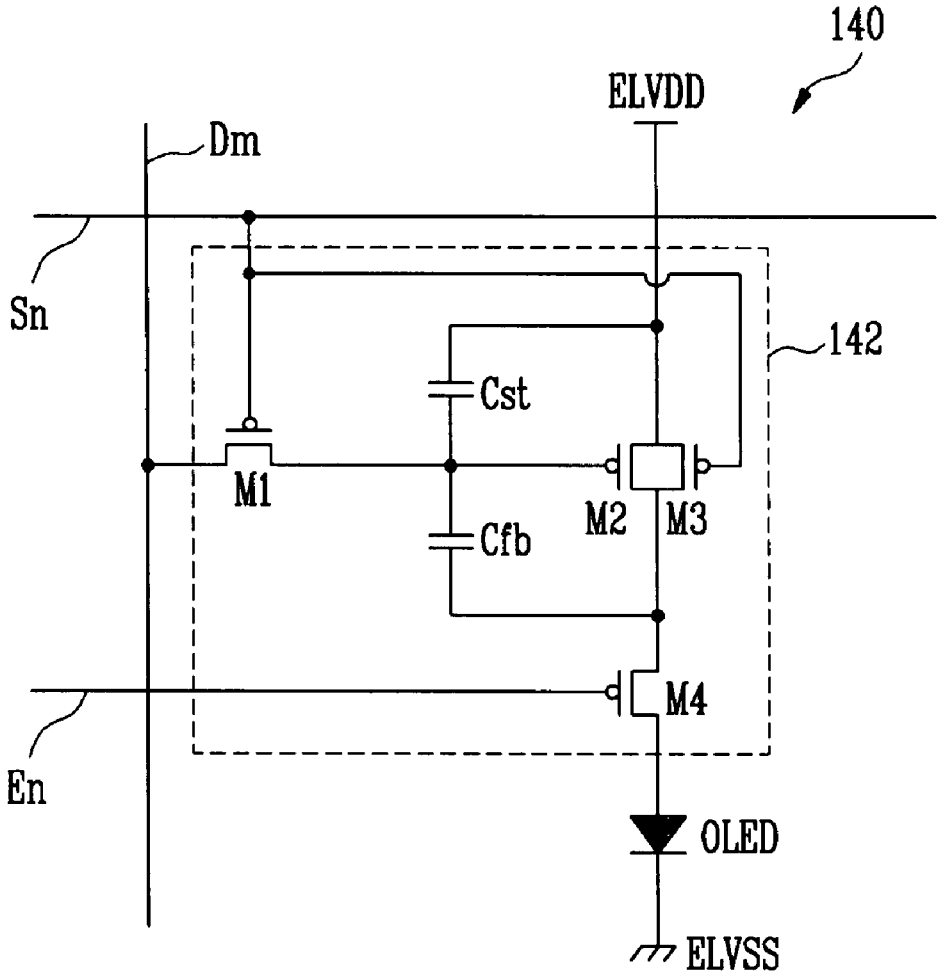
FIG. 2 illustrates a circuit diagram of a pixel circuit according to an embodiment of the present invention.

FIG. 2 illustrates a circuit diagram of a pixel circuit according to an embodiment of the present invention. In FIG. 2, a pixel 140 is connected to an $n^{th}$ scan line Sn and an $m^{th}$ data line Dm. Referring to FIG. 2, the pixel 140 of the present invention may include an OLED and a pixel circuit 142. The pixel circuit 142 may be connected to the data line Dm, the scan line Sn, and an $n^{th}$ emission control line En, and may control the OLED.

An anode electrode of the OLED may be connected to the pixel circuit 142, and a cathode electrode of the OLED may be connected to the second power supply ELVSS. The OLED may generate light having a predetermined luminance corresponding to an electric current from the pixel circuit 142.

When the scan signal at a first level is supplied to the scan line Sn, the pixel circuit 142 may control an amount of an electric current supplied to the OLED corresponding to a data signal, which is supplied to the data line Dm. A predetermined electric current from a drive transistor included in the pixel circuit 142 may be supplied to the OLED, and a predetermined voltage may be applied to the OLED.

As shown in FIG. 2, in the pixel circuit 142 according to an embodiment of the present invention, the pixel circuit 142 may provide a negative feedback of the predetermined voltage applied to the OLED to a gate electrode of a drive transistor. Thus, the pixel circuit 142 may compensate a threshold voltage and mobility of the drive transistor.

In detail, the pixel circuit 142 may include first to fourth transistors M1 to M4, a storage capacitor Cst, and a feedback capacitor Cfb. A gate electrode of the first transistor M1 may be coupled to the scan line Sn, and a first electrode thereof may be coupled to the data line Dm. Further, a second electrode of the first transistor M1 may be coupled to a gate electrode of the second transistor M2, which may be the drive transistor.

A gate electrode of the second transistor M2 may be coupled to a second electrode of the first transistor M1, and a first electrode of the second transistor M2 may be coupled to the first power supply ELVDD. Further, a second electrode of the second transistor M2 may be coupled to a first electrode of the fourth transistor M4.

A gate electrode of the third transistor M3 may be coupled to the scan line Sn, and a first electrode of the third transistor M3 may be coupled to the first power supply ELVDD. Further, a second electrode of the third transistor M3 may be coupled to a first electrode of the fourth transistor M4.

The first electrode of the fourth transistor M4 may be coupled to the second electrode of the second transistor M2, and a second electrode of the fourth transistor M4 may be coupled to the OLED. Further, a gate electrode of the fourth transistor M4 may be coupled to the emission control line En. In an implementation (not shown), the fourth transistor M4 may be omitted, in which case the second electrode of the second transistor M2 may be directly coupled to the anode electrode of the OLED.

One electrode of the storage capacitor Cst may be coupled to the gate electrode of the second transistor M2, and another electrode of the storage capacitor Cst may be coupled to the first electrode of the second transistor M2. One electrode of the feedback capacitor Cfb may be coupled to the gate electrode of the second transistor M2, and another electrode of the feedback capacitor Cfb may be coupled to the second electrode of the second transistor M2.

In operation of the pixel circuit 142, when the scan signal at the first level is supplied to the scan line Sn, the first transistor M1 may be turned on and transfer the data signal supplied to the data line Dm to the gate electrode of the second transistor M2. Also, when the first transistor M1 is turned-on, the storage capacitor Cst may be charged with a voltage corresponding to the data signal. The second transistor M2 may control the amount of electric current from the first power supply ELVDD to the second power supply ELVSS through the OLED corresponding to the voltage applied to the gate electrode of the second transistor M2. The scan signal at the first level may also be supplied to the gate electrode of the third transistor M3, which may transfer a voltage of the first power supply ELVDD to the first electrode of the fourth transistor M4. When the emission control signal at a second level is provided to the emission control line En, the fourth transistor M4 may be turned-off, whereas, when the emission control signal at a first level is provided, the fourth transistor M4 may be turned-on. The feedback capacitor Cfb may feed back a voltage variation amount in the second electrode of the second transistor M2 to the gate electrode of the second transistor M2.

Figure 3:
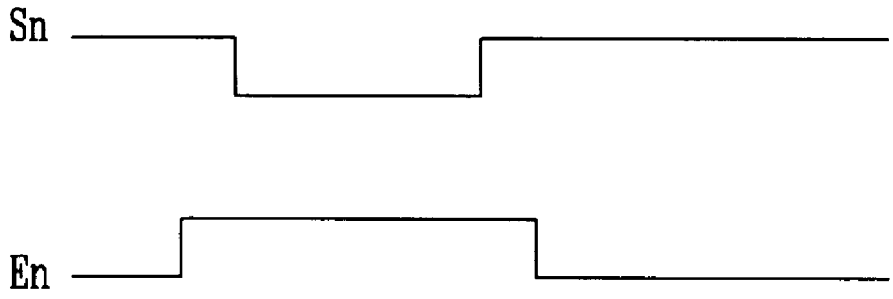
FIG. 3 illustrates a waveform diagram in a method of driving the pixel circuit shown in FIG. 2.

FIG. 3 illustrates a waveform diagram in a method of driving the pixel circuit shown in FIG. 2. Referring to FIG. 3, an emission control signal applied to the emission control line En may have a pulse width that is greater than a pulse width of a scan signal applied to the scan line Sn. For an emission control signal supplied to an $i^{th}$ emission control line Ei and a scan signal supplied to a corresponding $i^{th}$ scan line Si, the emission control signal may not be at the first level when the scan signal is at the first level, i.e., the emission control signal at the first level and the scan signal at the first level may not overlap.

Referring to FIGS. 2 and 3, before the scan signal at the first level is supplied to the scan line Sn, the emission control signal at the first level may be supplied to an emission control line En, which may turn on the fourth transistor M4. Next, the scan signal at the first level may be supplied to the scan line Sn, which may turn on the first transistor M1 and the third transistor M3.

Figure 4:
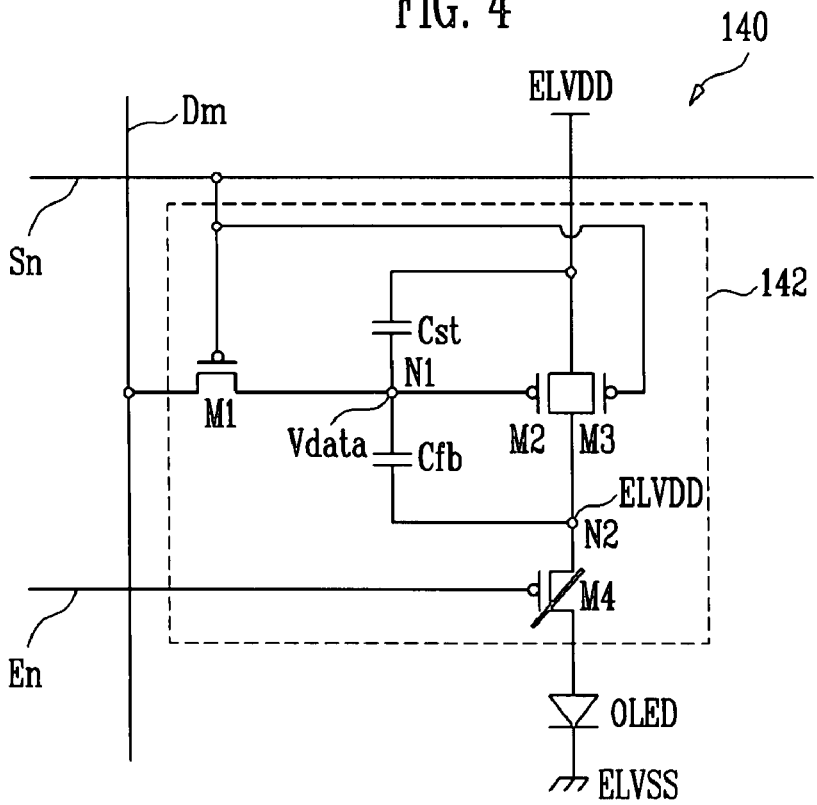
FIGS. 4 and 5 illustrate circuit diagrams of operational states in a method of driving the pixel circuit shown in FIG. 2.
Figure 5:
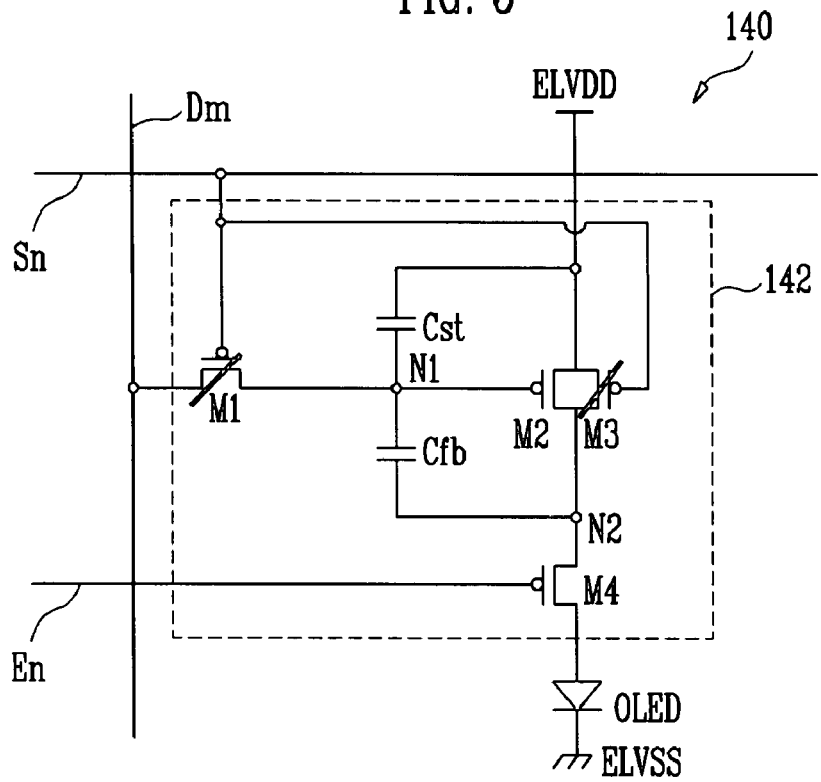

FIGS. 4 and 5 illustrate circuit diagrams of operational states in a method of driving the pixel circuit shown in FIG. 2. Referring to FIGS. 2-4, when the scan signal at the first level is provided to the scan line Sn and the first transistor M1 is turned-on, as shown in FIG. 4, a data voltage Vdata corresponding to a data signal may be applied to a first node N1. Accordingly, the storage capacitor Cst may be charged with a voltage corresponding to a difference between the data voltage Vdata and a first power supply ELVDD. Further, when the third transistor M3 is turned-on, a voltage of the first power supply ELVDD may be supplied to a second node N2.

Thereafter, the scan signal may be at the second level and the emission control signal may be at the first level. Accordingly, as shown in FIG. 5, the first transistor M1 and the third transistor M3 may be turned-off, and the fourth transistor M4 may be turned-on.

At this time, the second transistor M2 may transfer an electric current, corresponding to the voltage applied to the first node N1, to the OLED. In this case, a voltage of the second node N2 may change as expressed by equation 1 below.

$$\Delta V_{N2}=ELVDD-V_{OLED} \quad \text{(Equation 1)}$$

In equation 1, $V_{OLED}$ represents a voltage applied to the OLED corresponding to an electric current flowing through the OLED. The voltage $V_{OLED}$ may be increased in proportion to an amount of an electric current flowing through the OLED.

With reference to the Equation 1, a voltage of the second node N2 may decrease from the voltage of the first power supply ELVDD by a voltage applied to the OLED. Accordingly, a voltage of the first node N1 set in a floating state by the feedback capacitor Cfb may be varied. In practice, a voltage variation amount of the first node N1 may be as expressed by Equation 2 below.

$$\Delta V_{N1}=V_{data}-V_{Cfb}/(V_{Cst}+V_{Cfb})\times\Delta V_{N2} \quad \text{(Equation 2)}$$

Thus, the voltage of the first node N1 may vary corresponding to a voltage variation amount of the second node N2. Because the voltage variation amount of the second node N2 may be associated with a threshold voltage of the second transistor M2, a voltage variation amount of the first node N1 may change corresponding to a threshold voltage of the second transistor M2.

Next, the second transistor M2 may transfer an electric current corresponding to a voltage applied to the first node N1 to the OLED, and the OLED may generate light of a predetermined luminance corresponding to the electric current supplied thereto.

As described above, the pixel circuit 142 according to an embodiment of the present invention may transfer the voltage applied to the OLED to a gate electrode of the second transistor M2, in correspondence with an amount of electric current supplied to the OLED from the second transistor M2, using a feedback capacitor Cfb. The electric current supplied to the OLED from the second transistor M2 may be affected by the threshold voltage of the second transistor M2. Thus, a non-uniformity in the threshold voltage of the second transistor M2 may be partially or fully compensated. This aspect of the pixel circuit 142 will be explained in additional detail with reference to Table 1 below.

TABLE 1

| | $V_{th}$ of M2 is small | $V_{th}$ of M2 is large |
|---|---|---|
| $I_{OLED}$ | large | small |
| $V_{OLED}$ | large | small |
| $\Delta V_{N1}$ | small | large |
| $\Delta V_{N2}$ | small | large |
| $\Delta I_{OLED}$ | small | large |
| Final emission current | $I_{OLED}$(large) + $\Delta I_{OLED}$(small) | $I_{OLED}$(small) + $\Delta I_{OLED}$(large) |

Table 1 presents a comparison of a smaller threshold voltage of the second transistor M2 and a larger threshold voltage thereof, for a same applied data signal. Referring to Table 1, when the threshold voltage Vth of the second transistor M2 is relatively small, a relatively large current may be supplied to the OLED corresponding to a data signal, i.e., $I_{OLED}$ is large. In this case, a large voltage may be applied to the OLED corresponding to an electric current supplied thereto, i.e., $V_{OLED}$ is large.

In operation of the pixel circuit 142, because the second node N2 may change to the voltage $V_{OLED}$ applied to the OLED from the first power supply ELVDD, a voltage variation amount may be small, i.e., $\Delta V_{N2}$ is small. In the same manner, a voltage variation amount of the first node N1 may be determined corresponding to a voltage variation amount of the second node N2, and may be a small value, i.e., $\Delta V_{N1}$ is small.

When the voltage variation amount of the first node N1 is small, the amount of an electric current flowing through the OLED may vary within a small range, i.e., $\Delta I_{OLED}$ is small. As a result, the electric current flowing through the OLED may only vary by a small current amount from the electric current $I_{OLED}$ corresponding to the data signal.

By comparison, when the threshold voltage Vth of the second transistor M2 is relatively large, a small current may be supplied to the OLED corresponding to the data signal, i.e., $\Delta I_{OLED}$ is small. In this case, a lower voltage may be supplied to the OLED, corresponding to the electric current supplied thereto, i.e., $V_{OLED}$ is small.

In operation of the pixel circuit 142, because the second node N2 may change to the voltage $V_{OLED}$ applied to the OLED from the first power supply ELVDD, a voltage variation amount may be large, i.e., $\Delta V_{N2}$ is large. In the same manner, a voltage variation amount of the first node N1 may be determined corresponding to a voltage variation amount of the second node N2, which may be a large value, i.e., $\Delta V_{N1}$ is large.

When the voltage variation amount of the first node N1 is large, the amount of electric current flowing through the OLED may vary within a large range, i.e., $\Delta I_{OLED}$ is large. As a result, the electric current flowing through the OLED may vary by a large current amount from the electric current $I_{OLED}$ corresponding to the data signal.

Thus, the pixel circuit 142 according to an embodiment of the present invention may change an amount of electric current flowing into the OLED in correspondence with the threshold voltage of the second transistor M2. Accordingly, a display according to an embodiment of the present invention may display an image of uniform luminance. Moreover, the pixel circuit 142 according to an embodiment of the present invention may be used for a pixel 140 having a relatively simple circuit of four transistors and two capacitors.

Another approach to providing a feedback voltage corresponding to an amount of an electric current flowing to the OLED may involve forming a pixel that includes a resistor having predetermined characteristics (not shown). However, it may be difficult or impossible to form such a resistor having the same characteristics in every pixel using known manufacturing techniques. For example, a significant resistance deviation may occur among the pixel resistors, which may render such an approach unsuitable. In contrast, the pixel circuit 142 according to an embodiment of the present invention feeds back the voltage applied to the OLED to the gate electrode of the second transistor M2 using a feedback capacitor Cfb.

Figure 6A:
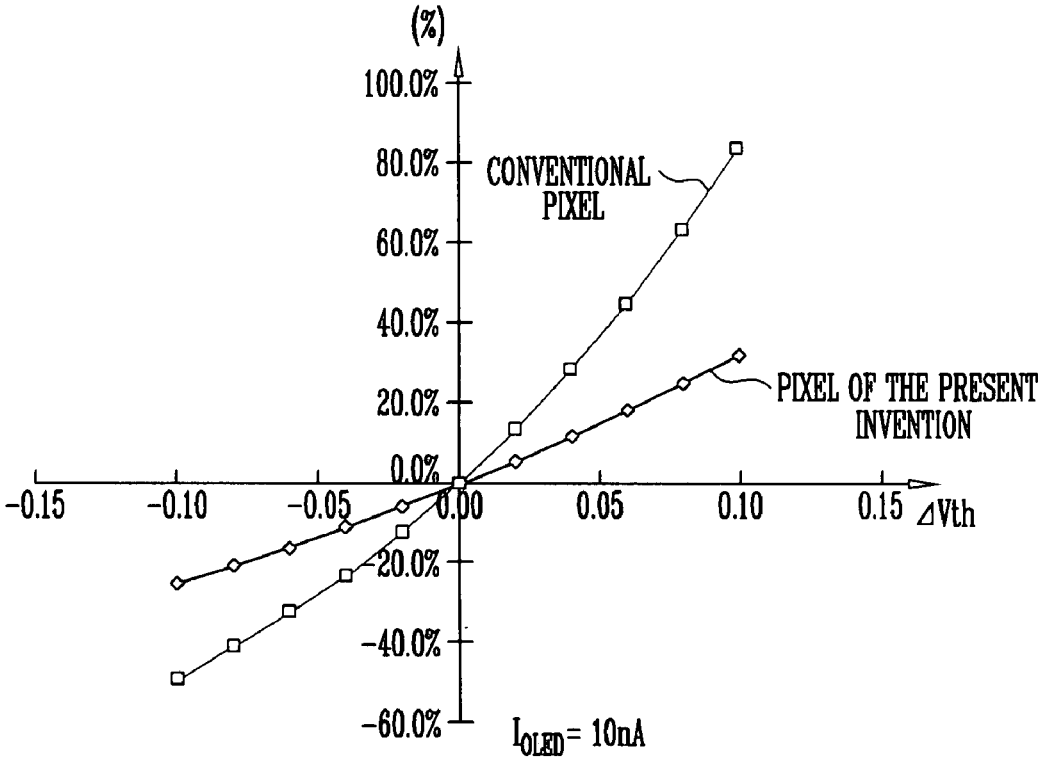
FIGS. 6A-6C illustrate graphs showing variations of electric current flowing through a pixel circuit according to a variation of a threshold voltage for a pixel circuit according to an embodiment of the present invention and a conventional pixel circuit.
Figure 6B:
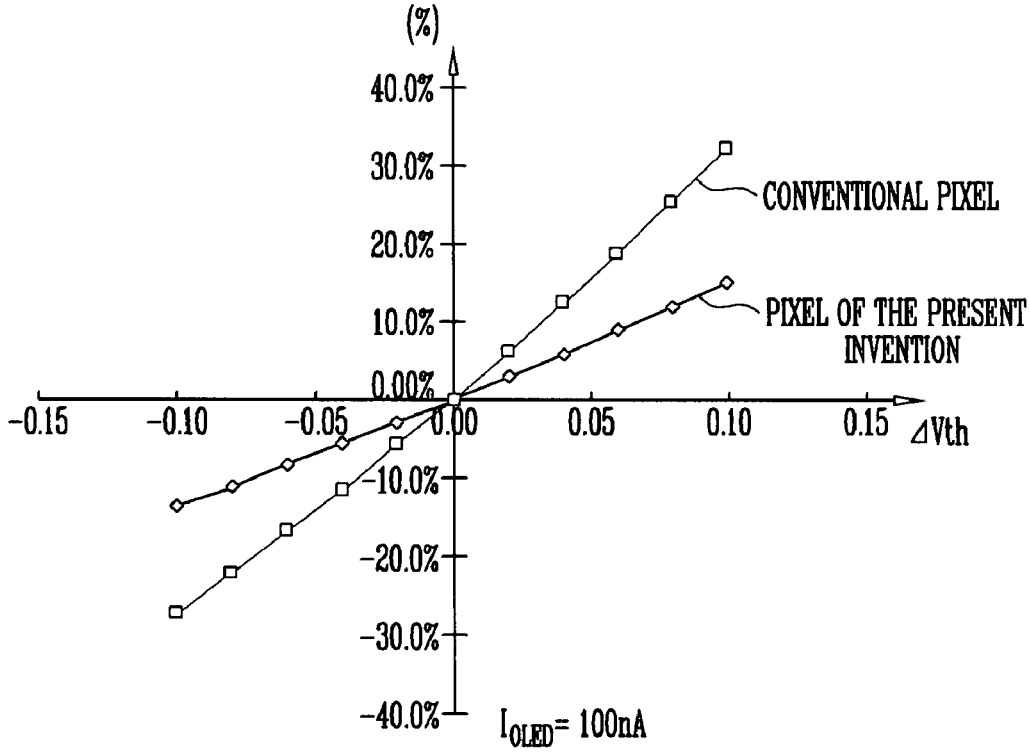
Figure 6C:
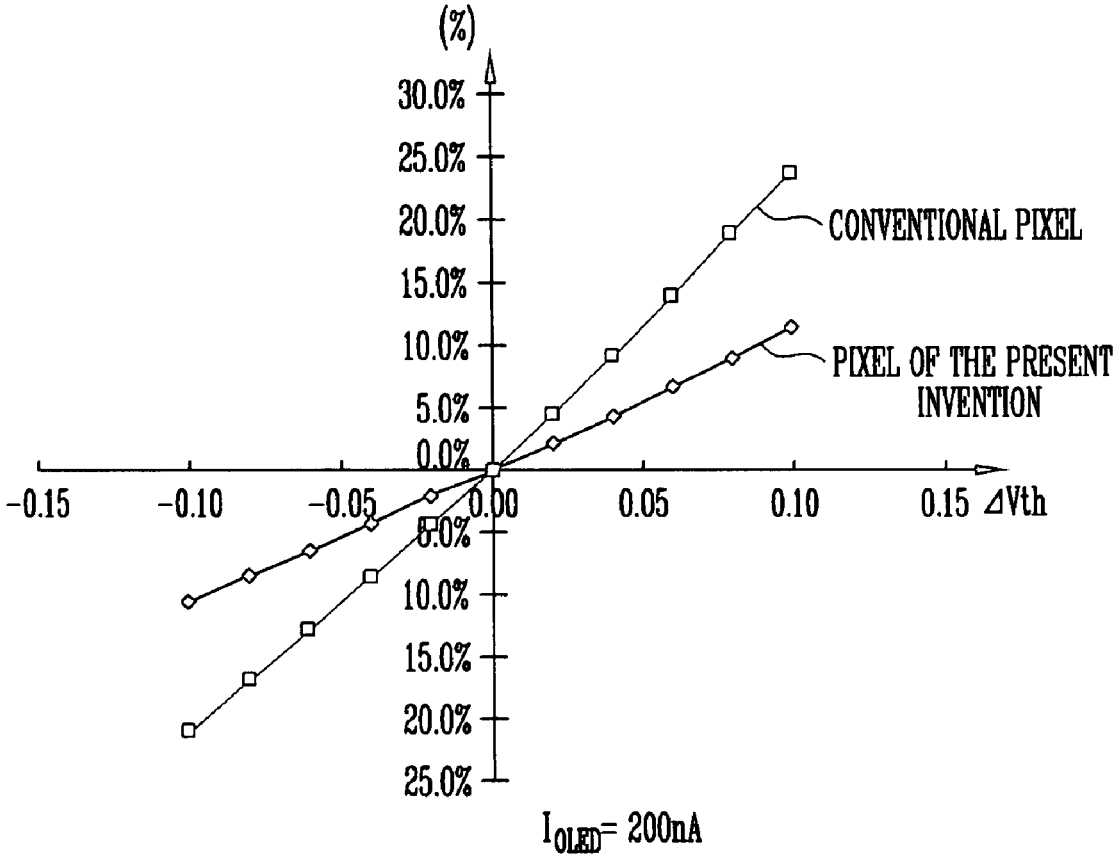

FIGS. 6A-6C illustrate graphs showing variations of electric current flowing through a pixel circuit according to a variation of a threshold voltage for a pixel circuit according to an embodiment of the present invention and a conventional pixel circuit. Referring to FIG. 6A, when an electric current $I_{OLED}$ of 10 nA is supplied to the OLED, a large current (about 80% of 10 nA) varies in a conventional pixel shown in FIG. 1, corresponding to a variation in the threshold voltage of the drive transistor. In contrast, in the pixel circuit 142 according to an embodiment of the present invention, a small current (about 30% of 10 nA) varies corresponding to a variation in the threshold voltage of the drive transistor.

Referring to FIG. 6B, when an electric current $I_{OLED}$ of 100 nA is supplied to the OLED, an electric current having a variation of about 35% of 100 nA varies in a conventional pixel corresponding to a variation in the threshold voltage of the drive transistor. In contrast, an electric current having a variation of about 15% of 100 nA varies corresponding to a variation in the threshold voltage of the drive transistor in the pixel circuit 142 according to an embodiment of the present invention.

Referring to FIG. 6C, when an electric current $I_{OLED}$ of 200 nA is supplied to the OLED, an electric current having a variation of about 25% of 200 nA varies in a conventional pixel corresponding to a variation in the threshold voltage of the drive transistor. In contrast, an electric current having a variation of about 12% of 200 nA varies in the pixel circuit 142 according to an embodiment of the present invention, corresponding to a variation in the threshold voltage of the drive transistor. Thus, in the pixel circuit 142 according to an embodiment of the present invention, a non-uniformity of the threshold voltage in the drive transistor may be partially or fully compensated.

As described above, since a pixel circuit, a display including the same, and a method for driving the display according to an embodiment of the present invention may provide a negative feedback of a voltage variation amount in a second electrode of a drive transistor to a gate electrode thereof, they may partially or fully compensate for non-uniformity of the threshold voltage in the drive transistor. Further, because the voltage feedback to the gate electrode of the drive transistor may be determined according to an amount of an electric current flowing through the drive transistor, the mobility of the drive transistor may be partially or fully compensated. In addition, the pixel circuit according to an embodiment of the present invention may compensate a threshold voltage of the drive transistor using only four transistors and two capacitors. Moreover, because each pixel may be coupled to one scan line, the need for additional wiring may be reduced.

Exemplary embodiments of the present invention have been disclosed herein, and although specific terms are employed, they are used and are to be interpreted in a generic and descriptive sense only and not for purpose of limitation. For example, particular embodiments of the present invention have been described as being implemented using PMOS transistors. However, it will be understood that embodiments of the present invention may also be implemented using NMOS transistors and driving signals having levels corresponding to the NMOS transistors. Accordingly, it will be understood by those of ordinary skill in the art that various changes in form and details may be made without departing from the spirit and scope of the present invention as set forth in the following claims.

What is claimed is:

1. A pixel circuit, comprising:

first, second, and third transistors, a first capacitor having a first electrode and a second electrode, and a second capacitor having a first electrode and a second electrode, wherein:

the first transistor is controlled by a scan line and is configured to controllably couple a data line to the first electrode of the first capacitor, the first electrode of the second capacitor, and a gate electrode of the second transistor, the second transistor is controlled by a voltage provided by the first and second capacitors, the second transistor having a first electrode coupled to a first power supply and being configured to controllably couple the first power supply to the second electrode of the second capacitor and to a light source, the third transistor is controlled by the scan line, the third transistor having a first electrode coupled to the first power supply and being configured to controllably couple the first power supply to the second electrode of the second capacitor and to the light source, the first power supply is controllably coupled to the light source by the second transistor and by the third transistor, the second and third transistors being arranged in parallel between the first power supply and the light source, a first electrode of the light source being coupled to a second electrode of the second transistor and a second electrode of the third transistor, a second electrode of the light source is coupled to a second power supply, and the first capacitor is coupled between the first transistor and the first power supply, and is configured to be charged with a voltage corresponding to a data signal when the first transistor is turned on, a voltage provided by the first power supply being higher than a voltage provided by the second power supply during charging of the first capacitor with the voltage corresponding to the data signal.

2. The pixel circuit as claimed in claim 1, wherein the light source is an organic light emitting diode.

3. The pixel circuit as claimed in claim 1, wherein the first, second and third transistors are PMOS transistors.

4. The pixel circuit as claimed in claim 1, wherein the first electrodes of the first and second capacitors are both coupled to the gate electrode of the second transistor.

5. The pixel circuit as claimed in claim 4, wherein:

a gate electrode of the first transistor is coupled to the scan line, and a first electrode of the first transistor is coupled to the data line, the gate electrode of the second transistor is coupled to a second electrode of the first transistor, a gate electrode of the third transistor is coupled to the scan line, and a second electrode of the third transistor is coupled to a second electrode of the second transistor, the first capacitor is coupled between the gate electrode and the first electrode of the second transistor, and the second capacitor is coupled between the gate electrode and the second electrode of the second transistor.

6. The pixel circuit as claimed in claim 1, further comprising a fourth transistor, wherein the fourth transistor is controlled by an emission control line and is configured to controllably couple the second and third transistors to the light source.

7. A display, comprising:

a scan driver configured to sequentially provide a scan signal to scan lines;

a data driver configured to provide a data signal to data lines; and pixels coupled to respective scan and data lines, each of the pixels having a pixel circuit as claimed in claim 1.

8. The display as claimed in claim 7, wherein:

the first transistor is configured to be turned-on when a scan signal at a first level is supplied to the scan line, the second transistor is configured to control an electric current flowing from the first power supply to a second power supply through the light source, the third transistor is configured to transfer a voltage of the first power supply to the second capacitor when the scan signal at the first level is supplied to the scan line, and the second capacitor is configured to regulate a voltage applied to a gate electrode of the second transistor based on a voltage output by the second transistor when an electric current is supplied to the light source.

9. The display as claimed in claim 7, wherein:

the scan driver is further configured to sequentially provide an emission control signal to emission control lines, the pixel circuit further includes a fourth transistor, wherein the fourth transistor is controlled by an emission control line and is configured to controllably couple the second transistor to the light source, and the fourth transistor is configured to be turned-on when the emission control signal at a first level is supplied to the emission control line.

10. The display as claimed in claim 9, wherein the emission control signal at the first level does not overlap the scan signal at the first level for a given pixel.

* * * * *